US012246906B2

(12) United States Patent
Newlands

(10) Patent No.: US 12,246,906 B2
(45) Date of Patent: Mar. 11, 2025

(54) ECOLOGICALLY SUSTAINABLE DISPENSER

(71) Applicant: Paulo Roberto Jannotti Newlands, Rio de Janeiro (BR)

(72) Inventor: Paulo Roberto Jannotti Newlands, Rio de Janeiro (BR)

( * ) Notice: Subject to any disclaimer, the term of this patent is extended or adjusted under 35 U.S.C. 154(b) by 4 days.

(21) Appl. No.: 17/976,811

(22) Filed: Oct. 30, 2022

(65) Prior Publication Data

US 2023/0242325 A1 Aug. 3, 2023

Related U.S. Application Data

(60) Provisional application No. 63/304,712, filed on Jan. 31, 2022.

(51) Int. Cl.
*B65D 83/00* (2006.01)

(52) U.S. Cl.
CPC ..... *B65D 83/0027* (2013.01)

(58) Field of Classification Search
CPC ..... B65D 83/086; B65D 83/0033; B65D 83/0011; A47G 19/183; G01F 11/027
USPC ..... 222/390
See application file for complete search history.

(56) References Cited

U.S. PATENT DOCUMENTS

| | | | | |
|---|---|---|---|---|
| 5,186,563 A * | 2/1993 | Gebhard | B65D 47/42 401/164 |
| 9,108,004 B2 * | 8/2015 | Rufer | A61M 5/31586 |
| 11,459,163 B2 * | 10/2022 | Hildebrandt | B65D 83/0011 |
| 11,691,785 B1 * | 7/2023 | Newlands, Sr. | B65D 83/0033 222/520 |

* cited by examiner

*Primary Examiner* — Paul R Durand
*Assistant Examiner* — Robert K Nichols, II

(57) ABSTRACT

Aiming to replace a vast assortment of plastic packages currently in massive use worldwide, the present invention relates to a dispenser that reduces waste with the ability to be periodically recharged with new refill packages made up of environmentally sustainable materials, being the core of the present invention the ability to cause an opposite movement of a loaded container against a piston located on top of a pin centralized at the set of parts that conform the lower half of the dispenser body, causing the compression and further expelling of the stored cargo through the container's nozzle, insofar that the referred container will be progressively embedded by screwing action enabled through compatible threading on the exterior of the refill packages and on the interior of a doubly threaded tube section which partially composes the lower half of the dispenser.

8 Claims, 7 Drawing Sheets

ECOLOGICALLY SUSTAINABLE DISPENSER

CROSS-REFERENCE TO RELATED APPLICATION—PRIORITY CLAIM

Figure 1A:
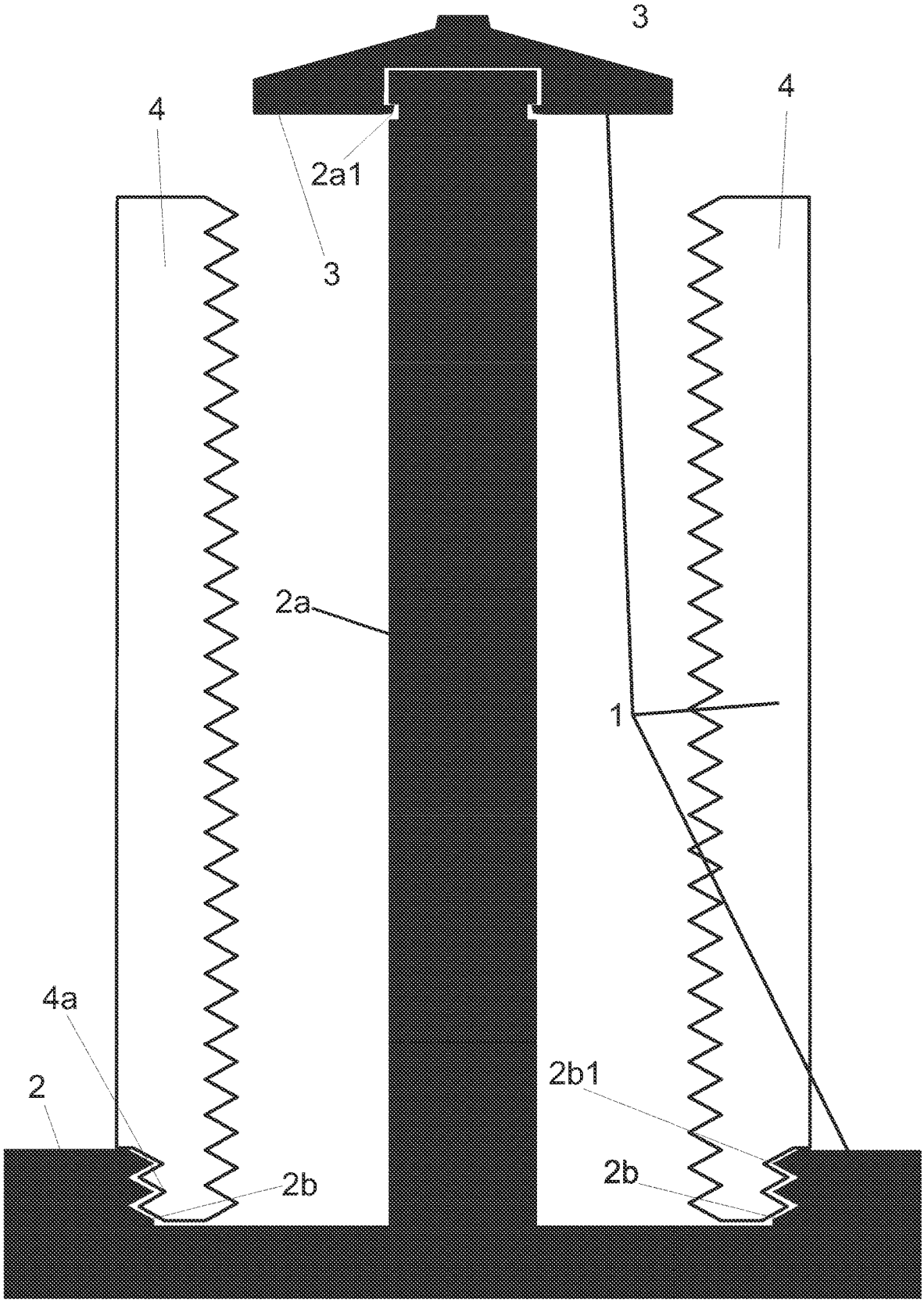

This application claims the benefit of priority to the U.S. Provisional Patent Application Ser. No. 63/304,712, filed Jan. 31, 2022, and entitled "SELF-DEPLOYED TELESCOPIC ACTUATOR AND DEVICES;"

The above-identified provisional patent applications, assigned to the assignee hereof, is incorporated herein by reference in its entirety.

1. FIELD OF THE INVENTION

Aiming the substitution of plastic packages currently in massive use worldwide, the present invention relates generally to the conception of a dispensing device mainly for pasty products that are usually loaded to plastic packages also comprising the ability to be periodically recharged with new refill packages made up of environmentally sustainable materials.

2. BACKGROUND

Since long ago, countless actions for creating or improving the functioning principles and utilities of dispenser of products have been attempted and sometimes achieved, as it can be noted through the vast array of devices for this aim available in the market, such as the below listed examples:

U.S. Pat. No. 10,888,889 granted by the USPTO on Jan. 12, 2021 to Brugger Gerhadt for "DISPENSER FOR DISPENSING LIQUID OR PASTY SUBSTANCES" which operates through the help of rotating piston pumps, rotary vane pumps, rotary piston pumps, gear pumps and similar pumps are used as rotating displacement pumps, without any similarity with the present patent claim.

U.S. Pat. No. 5,011,317, granted by the USPTO on Apr. 30, 1991 to Guerret for "DISPENSER INCLUDING A TRANSLATABLE PISTON" which proposes a mechanism for controlling the feed of a rod for dispensing its content, without any similarity with the present patent claim.

U.S. Pat. No. 4,848,598 granted by the USPTO on Jul. 18, 1989 to the assignee Colgate-Palmolive Company for "DISPENSING DEVICE" wherein a hand-help pump type has an internal piston which is pulled up by a rod passing through the piston, which rod is moved by an actuator, without any similarity with the present patent claim.

Patent 20210163213 granted by the USPTO on Jun. 23, 1989 to Yan Jian for "DISPENSING PUMP AND MANUFACTURING METHOD THEREOF" in which the device's content is expelled by means of an air pump mechanism, without any similarity with the present patent claim.

U.S. Pat. No. 3,128,923 granted by the USPTO on Apr. 14, 1964 to Gabler for "CONTAINER FOR RECEIVING AND DELIVERING PASTY SUBSTANCES" in which the device's content is expelled by means of a spring mechanism, without any similarity with the present patent claim.

U.S. Pat. No. 4,511,068 granted by the USPTO on Apr. 16, 1985 to Bossina for "DISPENSER FOR PASTE-LIKE PRODUCTS" in which the device's content is expelled by means of a spring mechanism, without any similarity with the present patent claim.

U.S. Pat. No. 4,598,843 granted by the USPTO on Jul. 8, 1986 to Foster for "TAKE-UP PISTON SHIPPING LOCK FOR VISCOUS PRODUCT DISPENSERS" in which the device's content is expelled by means of an atmospheric pressure-operated piston, without any similarity with the present patent claim.

U.S. Pat. No. 4,139,127 granted by the USPTO on Feb. 13, 1979 to Gentile for "PLUNGER-TYPE DISPENSER WITH RATCHET ACTUATOR" in which the device's content is expelled by means for controlling the direction of rotation of a rotatable member, without any similarity with the present patent claim.

U.S. Pat. No. 4,979,646 granted by the USPTO on Dec. 25, 1990 to Andris for "PASTE DISPENSER" in which the device's content is expelled by means of bellows, without any similarity with the present patent claim.

In spite of the great evolutions and benefits brought to the field of dispensing products by the state of the art hereby described through the above listed patents, apart from many other existing models, there is still a need for the introduction of compact, uncomplicated and low cost devices, such as the presently disclosed Ecologically Sustainable Dispenser, for a large sort of application which allow from one side, the utilization of a simple device that will not require any particular mechanical skill from users, and also an opportunity for using replaceable packages environmentally correct, made up as from sustainable materials aiming the replacement of the plastic packages presently in massive use worldwide.

Considering that some technical problems and shortcomings that the current art has not yet overcome until now, the present invention is being disclosed with the aim to mitigate and obviate the aforementioned problems.

3. SUMMARY OF THE INVENTION

The feasibility of the present invention is based on the utility resulted from the arrangement of the four individuals but self-complementary pieces that conform the total body of the Ecologically Sustainable Dispenser of the present invention, including the three ones that comprises the set of parts (1) that is embodied in the Ecologically Sustainable Dispenser lower half:

1. A circular sustaining base for the whole device, being such a base fitted with a central pin.
2. A rotatable piston attached to the top of the central pin.
3. An internally and externally threaded tube segment;
4. A container (5) loaded with the desired product to be dispensed, comprising at its external lower portion an external disc (5*a*) fitted with threading lines (5*a*1) fully compatible with the threading lines existing at the tube segment (4).

In order to accomplish with the patent's fundamental aim of cherish the environment, the aforementioned replaceable container is to be made up of sustainable packaging materials such as aluminum for storing the selected products such as toothpaste, paste soap for toilets washbasins and kitchen sinks, paste hair shampoos and conditioners, food and spices and many more.

Thus, it is a paramount objective of the present invention to contribute for the improvement of ecosystems against the inconsequent human disposal of toxic waste like, for instance, the plastic toothpaste tubes that according to some reports available at Internet are disposed in landfills in amounts over the twenty billion units per year, being therefore strongly advisable that any container used for storing the dispensable products be made up, as previously described, from ecologically friendly materials, i.e. designed to have little or even no damaging effect on the environment, such is the case of the aluminum by-products that can be endlessly recyclable, within a circular economy strategy aimed to achieve environmental targets fully compatible to a toxic-free environment.

It is another objective of the present invention to disclose a method and all necessary parts for creating an Ecologically Sustainable Dispenser capable for replacing unsuitable packaging materials presently applied for storing of an array of utility products by harmless ecological materials.

It is another objective of the present patent to dispose a device that will allow the dispensing of products through a friendly and easily manipulating device.

It is another objective of the present patent the creation of an Ecologically Sustainable Dispenser fitted with the ability of being periodically replaced by fully recyclable sustainable containers loaded with products that are presently in commonly used, by subsequent refills fully loaded with renewed amounts of the desired products.

It is another objective of the present patent the introduction of a dispensing device that will allow the replacement of the current environmentally aggressive plastic packages by sustainable ones made up, for instance by aluminum structure.

The above referred functions and effects might be represented and achieved, without any limitation, through feasible and adequate means, as depicted by the related drawings hereby embodied.

4. DETAILED DESCRIPTION OF THE DRAWINGS

In order to propose a comprehensive description of the present invention, the representative figures drawn up for this effect were divided in three blocks being the first one comprising the description of the fully assembled lower set of parts of the Ecologically Sustainable Dispenser (1), the second block referring to the description of the storing container and the third one, the disclosing of two exemplary holders for the Ecologically Sustainable Dispenser.

Thus, FIG. 1A shows in a cut view that the lower set of parts (1) of the Ecologically Sustainable Dispenser is already fully assembled but still remaining in a static position in which the round sustaining base (2), fitted with a central pin (2*a*), has already received the screwed attachment of the tube segment (4) whose external threading lines (4*a*) have been inserted in the compatible internal threading lines (2B1) of the inner disc (2B) existing on the round sustaining base (2).

At this same FIG. 1A it can be noted that the piston (3) in a trapezoidal spearhead shape has been also attached into the groove (2*a*1) existing at the top of the central pin (2*a*).

Figure 1B:
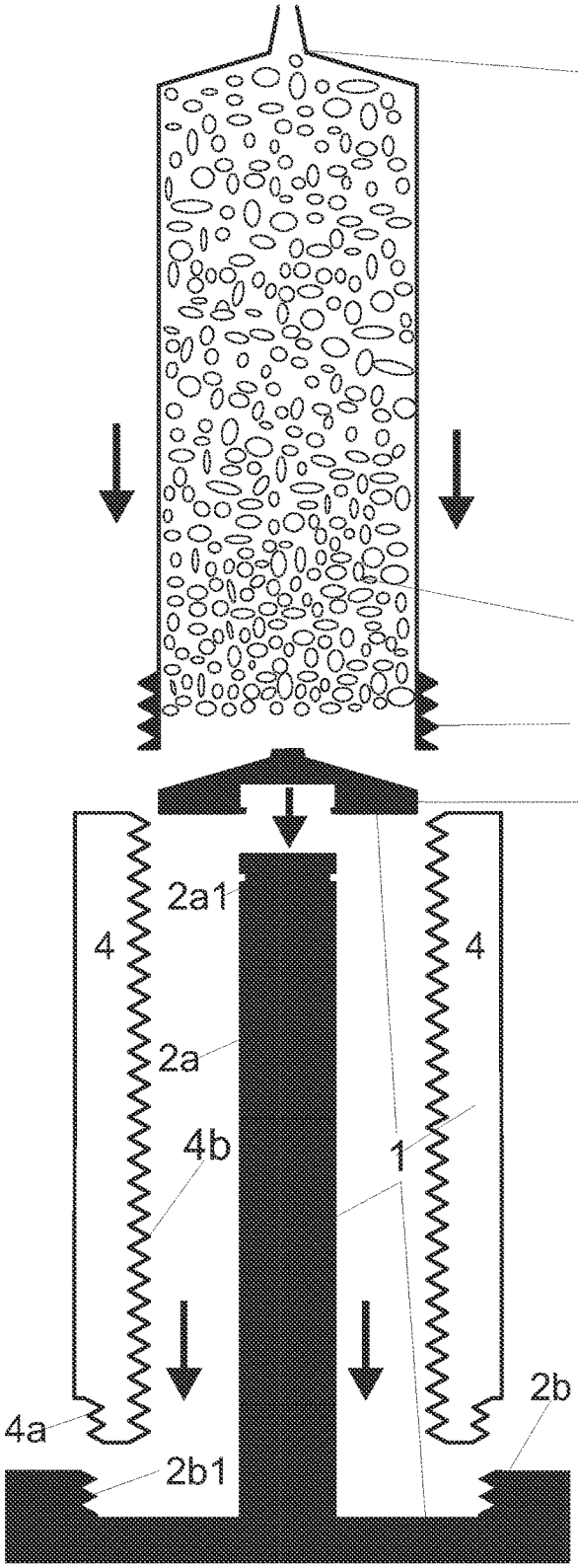
Figure 1C:
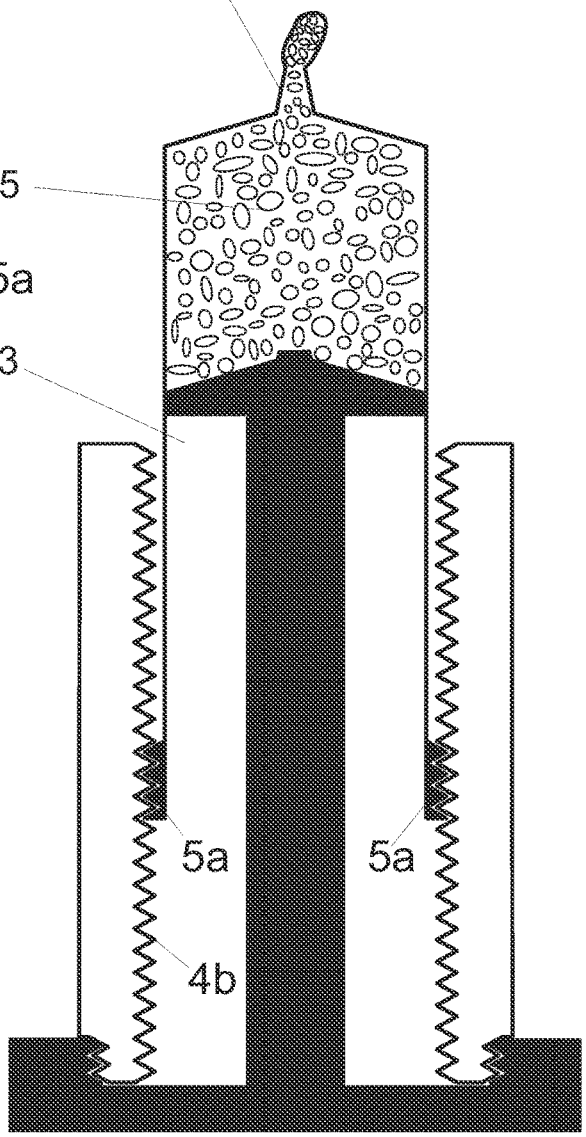

FIGS. 1B and 1C disclose in detailed exploded view, the same assembling routine as described in FIG. 1A, however including now, as the upper body which completes the Ecologically Sustainable Dispenser, a container (5) tapered on its upper end in order to accommodate a piston (3) with identical shape so that it will be sure that the whole content of said container (5) will be dispensed.

Therefore, the piston (3) will be attached to the groove (2*a*1) existing at the top of the central pin (2*a*) while the tube segment (4) that is fitted with external threading lines (4*a*) will be screwed into the internal threading lines (2*b*1) located at the inner disc (2*b*).

Upon the completion of the above described steps aiming the assembling of the lower set of parts (1) of the Ecologically Sustainable Dispenser, the container (5) fully loaded with the selected product to be dispensed, will be then displaced towards the referred lower set of parts (1) where, through its external threaded disc (5*a*), it will be fit in the internal threading lines (4*b*) located along the inner wall of the tube segment (4), which, as represented by FIG. 1C, will result in the Ecologically Sustainable Dispenser disclosed by the present invention.

The conclusive effect searched by the device disclosed by the present invention can be seen on FIG. 1C where it is shown that after the two parts of the Ecologically Sustainable Dispenser, i.e., the lower set of parts (1) and the container (5), have been moved against each other, about half the content of the container (5) has been pressed by the rotatable piston (3) against the container's nozzle (5*c*) through which it has been dispensed, as expected.

In other words, the core of the present invention is to cause the opposite movement of a loaded container (5) against the central pin (2*a*) existing at the lower set of parts (1) that will cause, as a consequence, the compression and expelling of the container's cargo through the container's nozzle (5*c*), insofar the referred container (5) is being progressively embedded by the lower set of parts (1) through the internal threading lines (4*b*) provided along the tube segment (4).

Figures 2A, 2B, 2C:
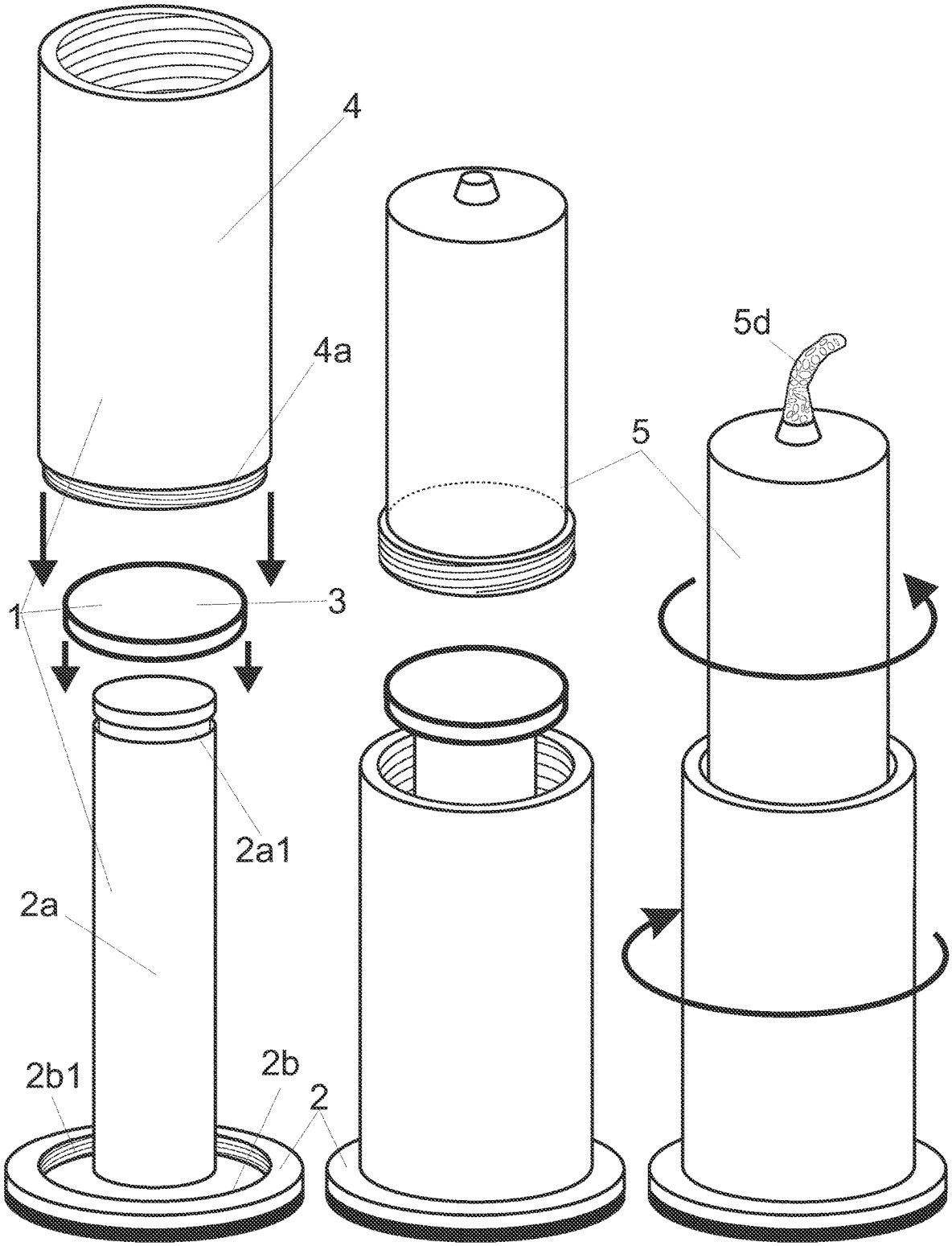

FIGS. 2A to 2C disclose in perspective view, the same assembling steps taken for getting the Ecologically Sustainable Dispenser fully ready to be used.

Therefore, and being displaced towards the direction indicated by the related arrows, the piston (3) will be attached to the groove (2*a*1) existing at the top of the central pin (2*a*) while the tube segment (4) that is fitted with external threading lines (4*a*) will be screwed into the internal threading lines (2*b*1) located at the inner disc (2*b*).

Additionally, it is demonstrated by the two arrows on FIG. 2C that, the dispensing of the desired portion (5*d*) of content stored at the container's (5) is simply accomplished just by turning the lower set of parts (1) of the Ecologically Sustainable Dispenser to one direction, and the upper one, which in this case is the container (5), to the opposite direction, causing this movement, as a consequence, the progressive threading insertion of the container (5) into the tube segment (4) up to a point where the bottom of the container (5) will be in touch with the surface of the round sustaining base (2), meaning so that as from that contact point the container (5) is totally empty and must be replaced.

To proceed with the replacement, the customer must simply rotate the round sustaining base (2) so that it can be unscrewed from the tube segment (4) causing this procedure the exposition of the open bottom of the container (5), still attached at the last internal threading lines (4*b*) existing along the tube segment (4), consequently allowing an access to keep manually turning the container (5) until it can be released from the tube segment (4), allowing therefore the screwing of a new, fully loaded refill to the upper end of the tube segment (4), after it has been once again attached to the round sustaining base (2).

Such rotational movements can be applied to the Ecologically Sustainable Dispenser by users either manually, when rotational impulses are given straight by user's hands over the two half over of the device, mechanically, when said impulse is applied through the use of a tool like a lever, for instance, or electrically when the device is outfitted with any sort of wired or wireless energetic actuator.

In a perspective view from below, FIGS. 3A to 3C expose the bottom of the container (5), aiming to disclose the sealing and closing system applied before sending the final product to customers at the retailing points.

Figures 3A, 3B, 3C:
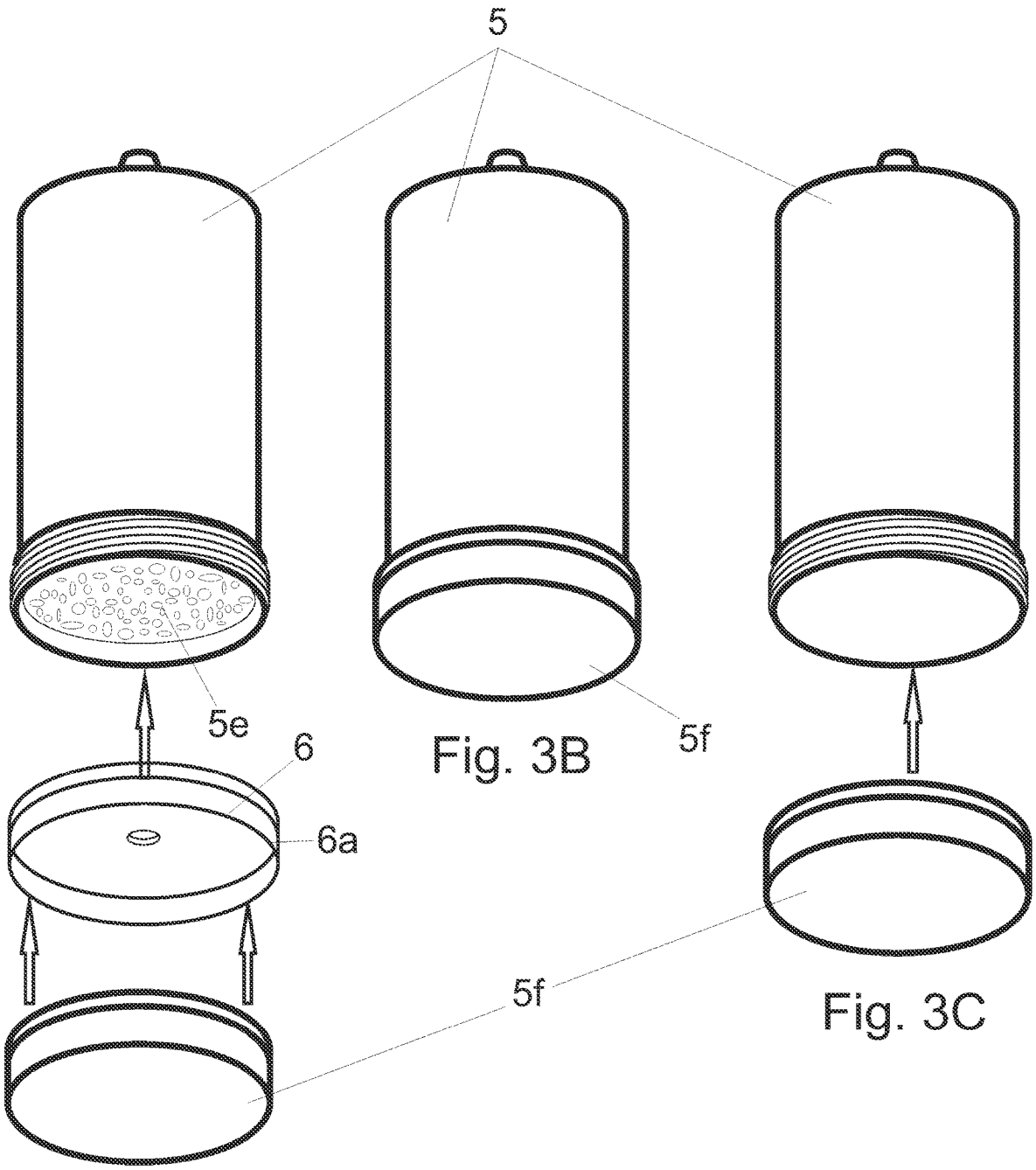

On top of FIG. 3A it is exposed a container (5) fitted with external threaded lines (5*a*) and fully loaded with the selected product (5*e*) to be dispensed.

Just below the bottom of the container (5) it is positioned a flat disc (6) fitted with a central exhaustion hole (6*a*) which can be used either as a sealant, after the container has been fully charged, and/or as a dispensing piston, or as an auxiliary piston which in this case will be positioned between the loaded product and the piston when the Ecologically Sustainable Dispenser is set in motion.

And finally, a removable and hermetic closing cap (5*f*) fitted with inner threading lines is positioned and ready to be screwed at the compatible, external threading lines (5*a*) positioned at bottom end of the container (5), aimed to assure the airtight condition of the loaded product as exhibited by FIG. 3B.

FIG. 3C discloses an empty container after its content has been totally dispensed, being ready to be closed again by the same hermetic closing cap (5*f*) that has been taken and saved when the container has been set in use and that will be now disposed along with the container for further recycling.

Figures 4A, 4B, 4C:
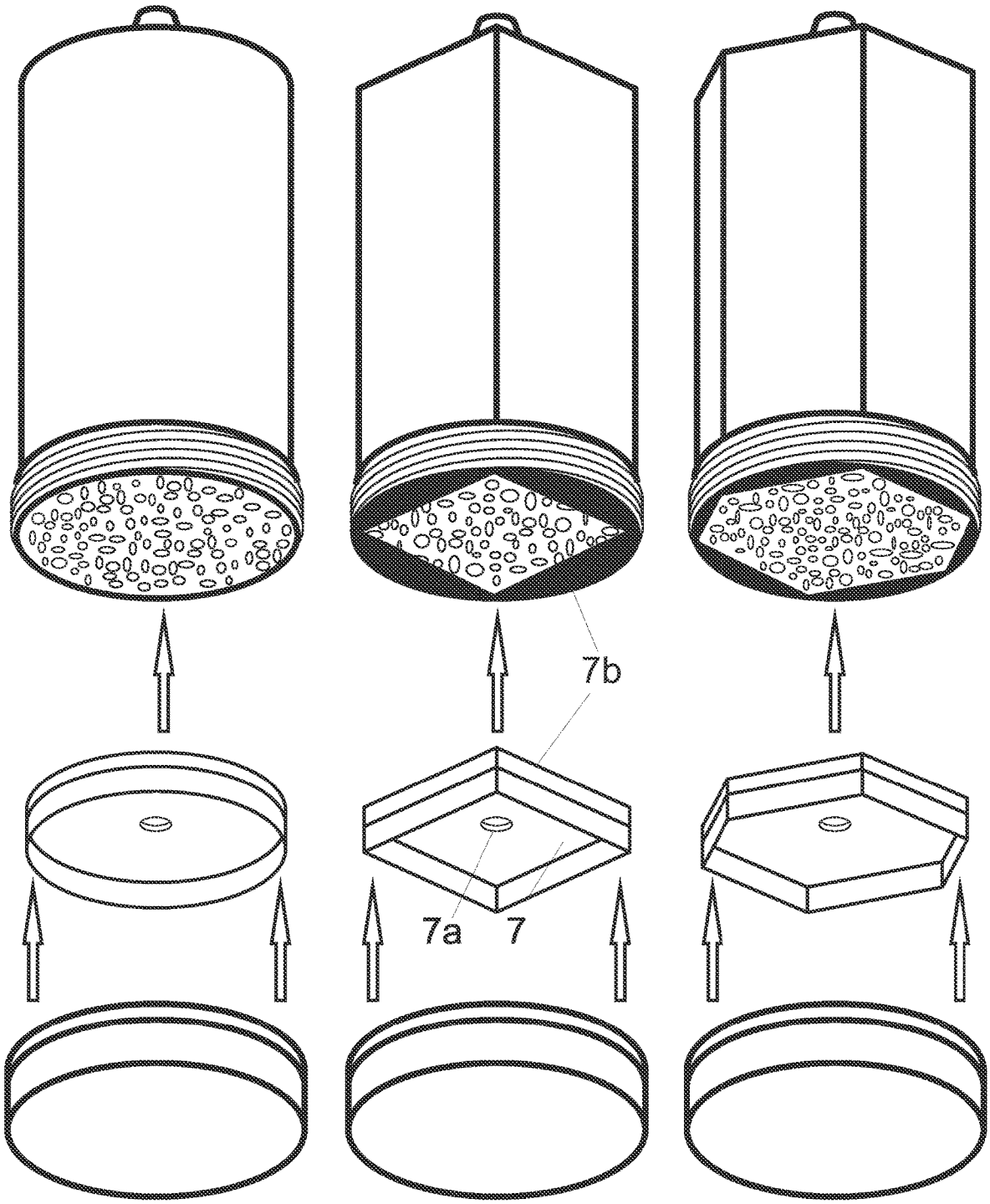

On FIGS. 4A to 4C, containers comprising alternative geometric shapes are disclosed.

As a matter of comparison, FIG. 4A is exhibiting a container with a round shaped storing chamber, similar to those previously described by FIGS. 3A to 3C.

Thus, the container disclosed by FIG. 4B comprises a square chamber where the selected product to be dispensed is stored.

In this case, both the piston located at the top of the central pin, which was conceived to push the stored product towards the container's nozzle, and the optional sealant element (7) outfitted with an exhaustion hole (7*a*) must bear a square shaped (7*b*) in order to be properly inserted into the square chamber of the container.

Likewise, the container disclosed by FIG. 4C was conformed in a hexagonal shape meaning so that its sealant element must bear a similar hexagonal shape to be compatible with the hexagonal format of the inner chamber existing in the related container.

FIGS. 5A, 5B, 6A and 6B disclose two examples of horizontal and vertical supports aimed to sustain the Ecologically Sustainable Dispenser during the dispensing which, in these cases is loaded with toothpaste.

Figure 5B:
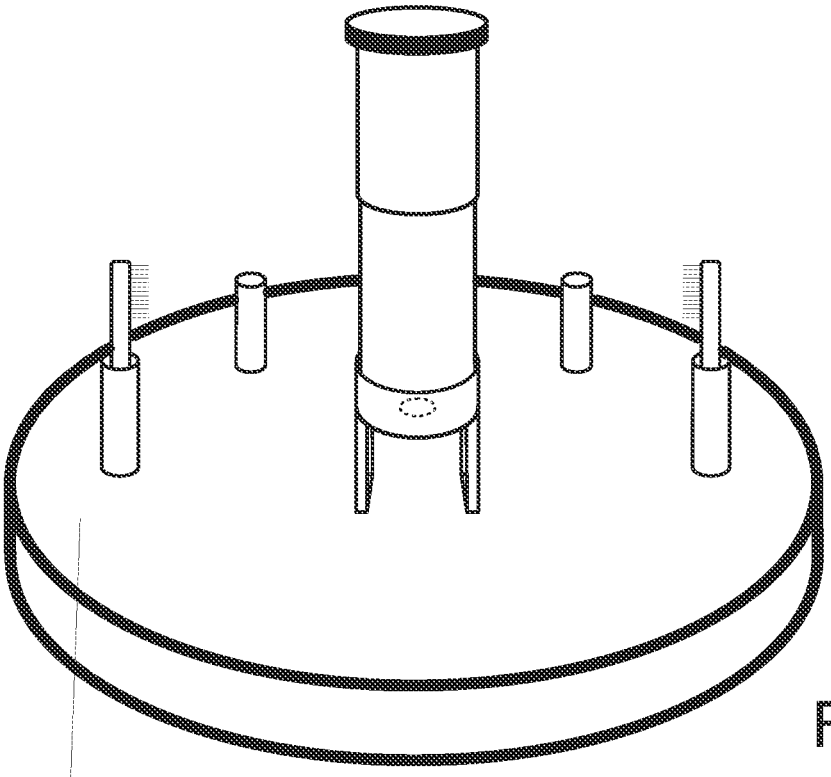
Figure 5A:
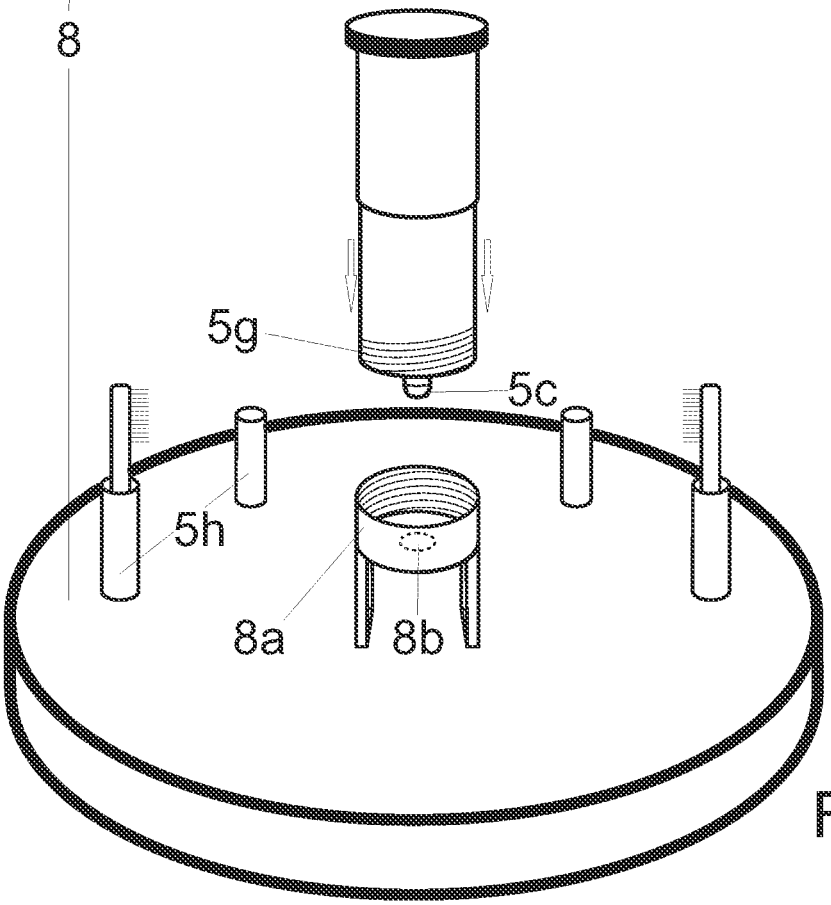

Thus, FIG. 5A shows up a model of vertically oriented support (8) for the Ecologically Sustainable Dispenser comprising a circular flat base in which a vertically oriented threaded socket (8*a*) fitted with a hole (8*b*) which is represented in this figure by a dotted line, aimed for the insertion of the container's nozzle (5*c*) has been centrally positioned so that an externally threaded disc (5*g*) positioned at the edge of the container (5) can be threaded therein, as disclosed by FIG. 5B. Additionally, this model can be fitted with a given amount of toothbrushes holders (5*h*).

Figure 6B:
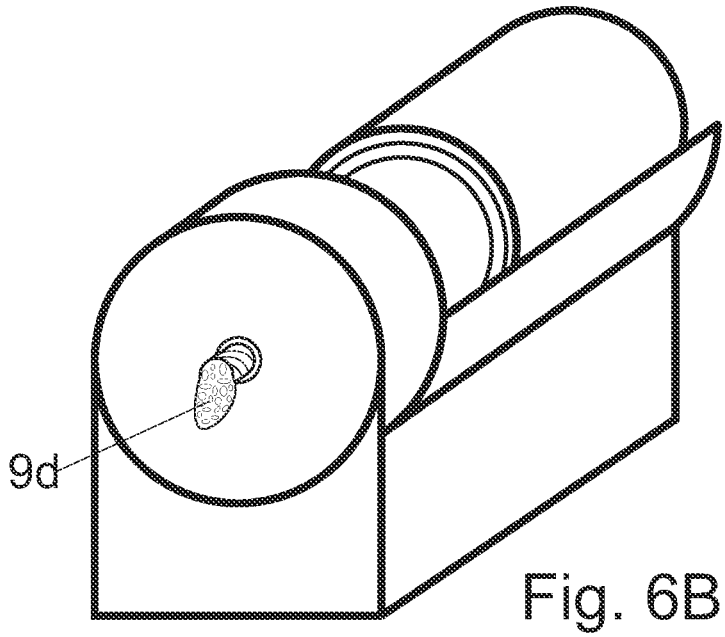
Figure 6A:
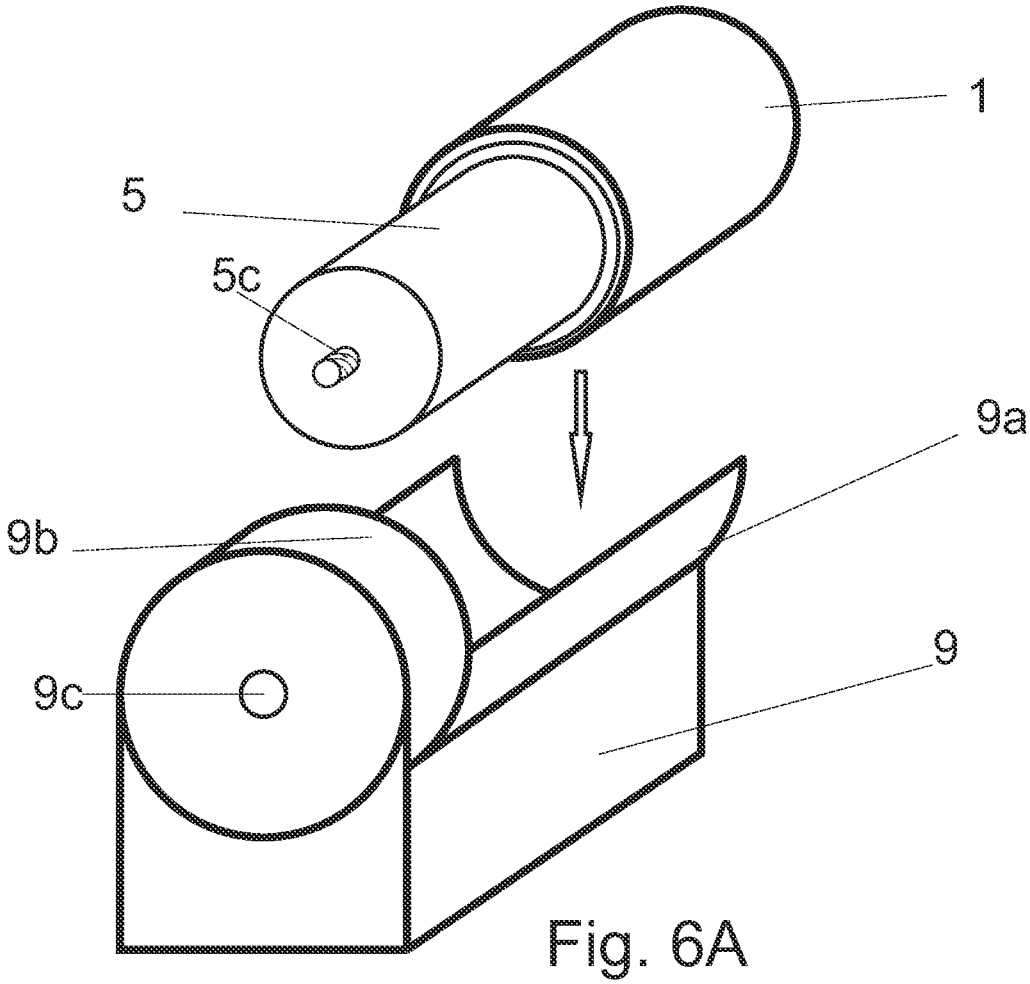

On FIG. 6A it is disclosed a model of support horizontally oriented (9) for the Ecologically Sustainable Dispenser comprising firstly a semicircular bed (9*a*) where the upper edge of the lower set of parts (1) of the Ecologically Sustainable Dispense will be uphold, and secondly, a socket (9*b*) also horizontally oriented and aimed for the smooth insertion of the upper edge of the container (5), also fitted with a centralized hole for the insertion of the container's nozzle (5*c*) through which the desired portion of toothpaste (9*d*) will be collected by users, as disclosed by FIG. 6B.

The invention claimed is:

1. An ecologically sustainable dispenser comprising:

an upper half and a lower half, having at said lower half a round sustaining base attached to a tube, said tube having internal threading along an entire length of said tube, said tube further having external threading, said lower half further including a central pin with a top end and a bottom end, said central pin attached to said round sustaining base, with a piston attached to said top end of said central pin, said upper half of including a pre-loaded, replaceable and ecologically sustainable container made from recyclable materials, said pre-loaded, replaceable and ecologically sustainable container having one open end that has external threading to fit the internal threading of the tube, said pre-loaded, replaceable and ecologically sustainable container further having one dispensing end fitted with a dispensing nozzle, such that when said pre-loaded, replaceable and ecologically sustainable container is screwed onto the lower half of the ecologically sustainable dispenser via interlocking of the internal threading of the tube and the external threading of the pre-loaded, replaceable and ecologically sustainable container, said pre-loaded, replaceable, and ecologically sustainable container is progressively incorporated by the lower half, causing the piston to push any contents of said pre-loaded, replaceable, and ecologically sustainable container through the dispensing nozzle, up to a certain screwing limit to indicate that all contents of said pre-loaded, replaceable and ecologically sustainable container have been dispensed and that the pre-loaded, replaceable, and ecologically sustainable container is totally empty and must be replaced.

2. The ecologically sustainable dispenser as in claim 1, wherein said round sustaining base further contains a disc-shaped inlay which possesses internal threading compatible with the external threading of the tube, such that the tube may be screwed into the disc-shaped inlay.

3. The ecologically sustainable dispenser, as in claim 1, wherein said pre-loaded, replaceable, and ecologically sustainable container further comprises a section outfitted with internal and external threading, that conforms the upper half of the dispenser, also comprising at the open end an external disc fitted with threading lines fully compatible with the inner threading of the tube.

4. The ecologically sustainable dispenser, according to claim 1 or 3, wherein the pre-loaded, replaceable and ecologically sustainable container comprises sustainable and recyclable packaging materials with the ability for being periodically recycled and indefinitely recharged with new refill packages made from environmentally sustainable materials.

5. The ecologically sustainable dispenser, as in claim 1, wherein the content of the pre-loaded, replaceable and ecologically sustainable container is dispensed by turning the lower half and the upper half of the ecologically sustainable dispenser in opposite directions.

6. The ecologically sustainable dispenser, as in claim 1, wherein replacement of the pre-loaded, replaceable and ecologically sustainable container comprises spinning the round sustaining base so that said round sustaining base can be unscrewed from the tube, exposing the open end of the pre-loaded, replaceable and ecologically sustainable container to gain access to said pre-loaded, replaceable and ecologically sustainable container, unscrewing said pre-loaded, replaceable and ecologically sustainable container from said tube, attaching the tube to the round sustaining base once again, and screwing a replacement onto the tube.

7. The ecologically sustainable dispenser, as in claim 1, further includes a flat disc outfitted with a central exhaustion hole, said flat disc sized to form an airtight seal when set against the open end of the pre-filled, replaceable and ecologically sustainable container, further including a removable closing cap outfitted with inner threadable lines compatible with the external threading of the open end of the pre-loaded, replaceable and ecologically sustainable container, said removable closing cap able to be reattached to the open end of the pre-filled, replaceable, and ecologically sustainable container, said removable closing cap further able to be recycled together with the pre-filled, replaceable and ecologically sustainable container.

8. The ecologically sustainable dispenser, as in claim 1, wherein the pre-filled, replaceable and ecologically sustainable container, while maintaining its open end with external threading that is compatible with the internal threading of the tube, internally comprises varied geometric formats to accommodate varied sealant geometric formats.

* * * * *